US009368066B2

(12) United States Patent
Zhai

(10) Patent No.: US 9,368,066 B2
(45) Date of Patent: Jun. 14, 2016

(54) PIXEL CIRCUIT, ORGANIC ELECTROLUMINESCENT DISPLAY PANEL AND DISPLAY DEVICE

(71) Applicants: Shanghai Tianma Micro-Electronics Co., Ltd., Shanghai (CN); Tianma Micro-Electronics Co., Ltd., Shenzhen (CN)

(72) Inventor: Yingteng Zhai, Shanghai (CN)

(73) Assignees: Shanghai Tianma Micro-Electronics Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

(21) Appl. No.: 14/590,940

(22) Filed: Jan. 6, 2015

(65) Prior Publication Data

US 2015/0379929 A1 Dec. 31, 2015

(30) Foreign Application Priority Data

Jun. 30, 2014 (CN) ..... 2014 1 0306587

(51) Int. Cl.
*G09G 3/32* (2016.01)
*G09G 3/36* (2006.01)

(52) U.S. Cl.
CPC ..... *G09G 3/3233* (2013.01); *G09G 3/3291* (2013.01); *G09G 3/3659* (2013.01); *G09G 2300/0819* (2013.01); *G09G 2300/0852* (2013.01); *G09G 2320/0233* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 8,314,756 | B2 | 11/2012 | Rankov et al. | |
| 2004/0196224 | A1 | 10/2004 | Kwon | |
| 2006/0125408 | A1 | 6/2006 | Nathan et al. | |
| 2011/0164018 | A1 * | 7/2011 | Kang | G09G 3/3233 345/211 |

(Continued)

FOREIGN PATENT DOCUMENTS

| | | | |
|---|---|---|---|
| CN | 1534578 | A | 10/2004 |
| CN | 102436793 | A | 5/2012 |

(Continued)

OTHER PUBLICATIONS

Office Action as issued in Chinese Application No. 201410306587.9, dated Oct. 8, 2015, and accompanying English translation.

*Primary Examiner* — Joseph Haley
(74) *Attorney, Agent, or Firm* — Alston & Bird LLP

(57) ABSTRACT

A pixel circuit is disclosed. The pixel circuit includes first and second capacitors, and a driving transistor, which generates a driving current. The pixel circuit includes a first transistor, controlled by a first driving signal, and which transmits a data signal to the first capacitor. The pixel circuit includes a second transistor, controlled by a second driving signal, and which transmits the data signal to the driving transistor. The pixel circuit includes a third transistor, controlled by the first driving signal, and which transmits a reference signal to the driving transistor. The pixel circuit includes a fourth transistor, controlled by a third driving signal, and which transmits the driving current to the light emitting element. The first capacitor stores the data signal and stabilizes the voltage between the gate and the source of the driving transistor, and the second capacitor stabilizes a source voltage of the driving transistor.

18 Claims, 11 Drawing Sheets

(56) References Cited

U.S. PATENT DOCUMENTS

2013/0120228 A1* 5/2013 Yoon ..... G09G 3/3291 345/80
2013/0127818 A1 5/2013 Tsai et al.
2013/0314305 A1* 11/2013 Liu ..... G09G 3/32 345/77
2015/0154906 A1* 6/2015 Chung ..... G09G 3/3233 345/212

FOREIGN PATENT DOCUMENTS

CN 102831859 A 12/2012
EP 1585100 A1 10/2005

* cited by examiner

*-- Conventional Art --*

PIXEL CIRCUIT, ORGANIC ELECTROLUMINESCENT DISPLAY PANEL AND DISPLAY DEVICE

CROSS-REFERENCES TO RELATED APPLICATIONS

This application claims the benefit of priority to Chinese Patent Application No. 201410306587.9, filed with the Chinese Patent Office on Jun. 30, 2014 and entitled "PIXEL CIRCUIT, ORGANIC ELECTROLUMINESCENT DISPLAY PANEL AND DISPLAY DEVICE", the content of which is incorporated herein by reference in its entirety.

TECHNICAL FIELD

The disclosure relates to the field of organic electroluminescence technology, and in particular to a pixel circuit, an organic electroluminescent display panel and a display device.

BACKGROUND OF THE INVENTION

Recently, the organic light emitting diode (OLED) displayer is one of the hotspots in the research field of flat-panel display. Compared to a liquid crystal displayer (LCD), the OLED has advantages such as low energy consumption, low production cost, self-illumination, wide viewing angle and fast response. Nowadays, in the fields such as mobile phone, personal digital assistant (PDA), digital camera, the OLED starts to take the place of the traditional LCD. The design of a pixel circuit is a core technology for the OLED displayer and has important research significance.

Different from the LCD in which the brightness is controlled using a stable voltage, the current-driven OLED needs a stable current to control light emit. Due to manufacture process and aging of the device, a threshold voltage Vth of the driving transistor in the pixel circuit may not be uniform, causing varying current passing through OLEDs at pixel points and uneven display brightness and affecting whole display effect of image.

BRIEF SUMMARY OF THE INVENTION

One inventive aspect is a pixel circuit for driving a light emitting element. The pixel circuit includes a first capacitor, a second capacitor, and a driving transistor, where the driving transistor is configured generate a driving current, where the magnitude of the driving current depends on a voltage difference between the gate and a source of the driving transistor. The pixel circuit also includes a first transistor, where the first transistor is controlled by a first driving signal and is configured to transmit a data signal to a first electrode of the first capacitor. The pixel circuit also includes a second transistor, where the second transistor is controlled by a second driving signal and is configured to transmit the data signal to a gate of the driving transistor. The pixel circuit also includes a third transistor, where the third transistor is controlled by the first driving signal and is configured to transmit a reference signal to the gate of the driving transistor. The pixel circuit also includes a fourth transistor, where the fourth transistor is controlled by a third driving signal and is configured to transmit the driving current from the driving transistor to the light emitting element. The first capacitor is configured to store the data signal and to stabilize the voltage difference between the gate and the source of the driving transistor, and the second capacitor is configured to stabilize a source voltage of the driving transistor.

Another inventive aspect is a pixel circuit for driving a light emitting element. The pixel circuit includes a first capacitor, a second capacitor, a driving transistor, and a first transistor, where a gate of the first transistor is connected to a first driving signal, a first electrode of the first transistor is connected to a data signal, and a second electrode of the first transistor is connected to a first electrode of the second transistor and to a first electrode of the first capacitor. The pixel circuit also includes a second transistor, a third transistor, and a fourth transistor, where the gate of the fourth transistor is connected to the third driving signal and the second electrode of the second capacitor, and a second electrode of the fourth transistor is connected to a first electrode of the light emitting element. A gate of the third transistor is connected to the first driving signal, a first electrode of the third transistor is connected to a reference signal, a drain of the driving transistor is connected to a first power source, a source of the driving transistor is connected to a second electrode of the first capacitor, to a first electrode of the second capacitor, and to a first electrode of the fourth transistor. In addition, a second electrode of the second capacitor is connected to a gate of the fourth transistor and to a third driving signal, and a second electrode of the light emitting element is connected to a second power source.

Another inventive aspect is an organic electroluminescent display panel including a plurality of pixel circuits. Each of the pixel circuits includes a first capacitor, a second capacitor, and a driving transistor, where the driving transistor is configured to generate a driving current, and where the magnitude of the driving current depends on a voltage difference between the gate and a source of the driving transistor. The pixel circuits also include a first transistor, where the first transistor is controlled by a first driving signal and is configured to transmit a data signal to a first electrode of the first capacitor. The pixel circuits also include a second transistor, where the second transistor is controlled by a second driving signal and is configured to transmit the data signal to a gate of the driving transistor. The pixel circuits also include a third transistor, where the third transistor is controlled by the first driving signal and is configured to transmit a reference signal to the gate of the driving transistor. The pixel circuits also include a fourth transistor, where the fourth transistor is controlled by a third driving signal and is configured to transmit the driving current from the driving transistor to the light emitting element. In addition, the first capacitor is configured to store the data signal and to stabilize the voltage difference between the gate and the source of the driving transistor, and the second capacitor is configured to stabilize a source voltage of the driving transistor.

Another inventive aspect is a display device including an organic electroluminescent display panel, the organic electroluminescent display panel including a plurality of pixel circuits, where each pixel circuit includes a first capacitor, a second capacitor, a driving transistor, a first transistor, a second transistor, a third transistor, and a fourth transistor, where a gate of the first transistor is connected to a first driving signal, a first electrode of the first transistor is connected to a data signal, a second electrode of the first transistor is connected to a first electrode of the second transistor and to a first electrode of the first capacitor, a gate of the second transistor is connected to a second driving signal, a second electrode of the second transistor is connected to a gate of the driving transistor and to a second electrode of the third transistor, a gate of the third transistor is connected to the first driving signal, a first electrode of the third transistor is connected to a reference signal, a drain of the driving transistor is connected to a first power source, a source of the driving transistor is connected to a second electrode of the first capacitor, to a first electrode of the second capacitor, and to a first electrode of the fourth transistor, a second electrode of the second capacitor is connected to a gate of the fourth transistor and to a third driving signal, the gate of the fourth transistor is connected to the third driving signal and to the second electrode of the second capacitor, and a second electrode of the fourth transistor is connected to a first electrode of the light emitting element, and a second electrode of the light emitting element is connected to a second power source.

DETAILED DESCRIPTION OF THE PREFERRED EMBODIMENTS

A pixel circuit, an organic electroluminescent display panel and a display device according to embodiments of the disclosure are described in detail in the following in conjunction with appended drawings.

Figure 1:
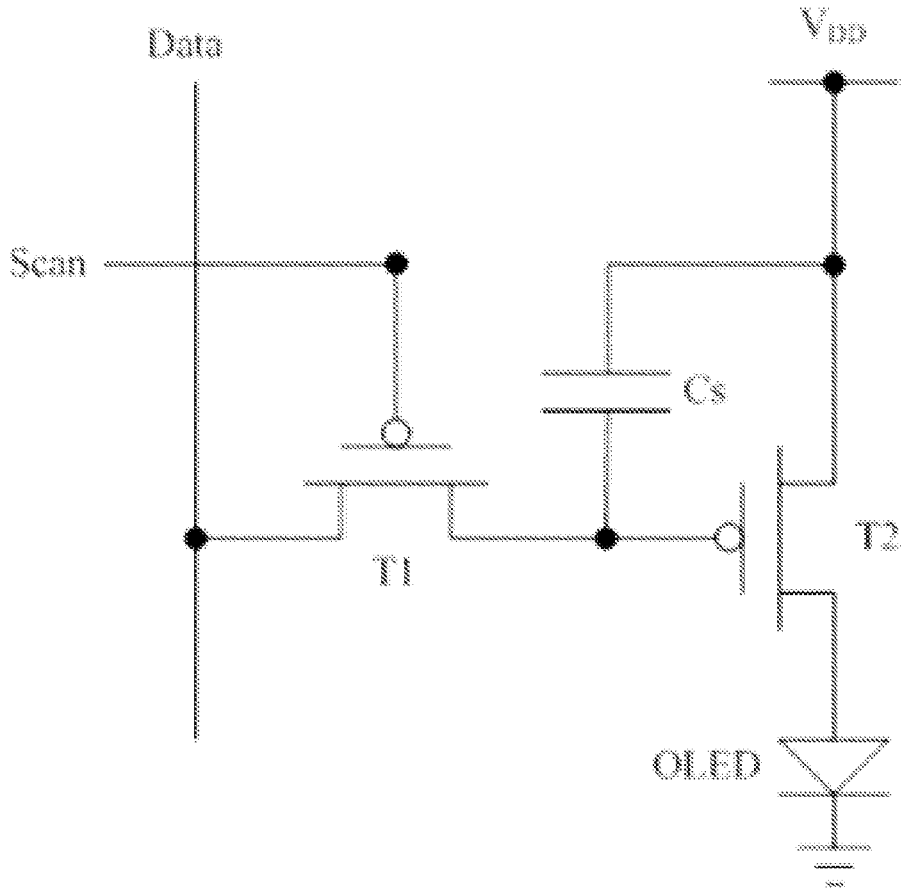
FIG. 1 is a schematic structural diagram of a conventional 2T1C pixel circuit.

As shown in FIG. 1, a conventional 2T1C pixel circuit is formed by a driving transistor T2, a switching transistor T1 and a storage capacitor Cs. When a row is selected by a scanning line Scan, the scanning line Scan inputs a low-level signal, the P-type switching transistor T1 is turned on, and a voltage at a data line Data is written into the storage capacitor Cs; after the scan for this row is finished, the signal input by the scanning line Scan goes high, the P-type switching transistor T1 is turned off, a gate voltage stored in the storage capacitor Cs enables the driving transistor T2 to generate a current to drive an OLED, ensuring that the OLED may continuously emit light in a duration of one frame. The saturation current of the driving transistor T2 may be expressed as $I_{OLED}=K(Vgs-Vth)^2$. As described above, due to the manufacture process and aging of device, the threshold voltage Vth of the driving transistor T2 may drift, and accordingly the current flowing through each OLED changes as threshold voltage Vth of driving transistor changes, and an uneven brightness of an image is caused.

In view of this, a pixel circuit, an organic electroluminescent display panel and a display device are provided according to the embodiments of the disclosure to solve the foregoing problem. Description is made in the following in conjunction with the appended drawings.

Figure 2:
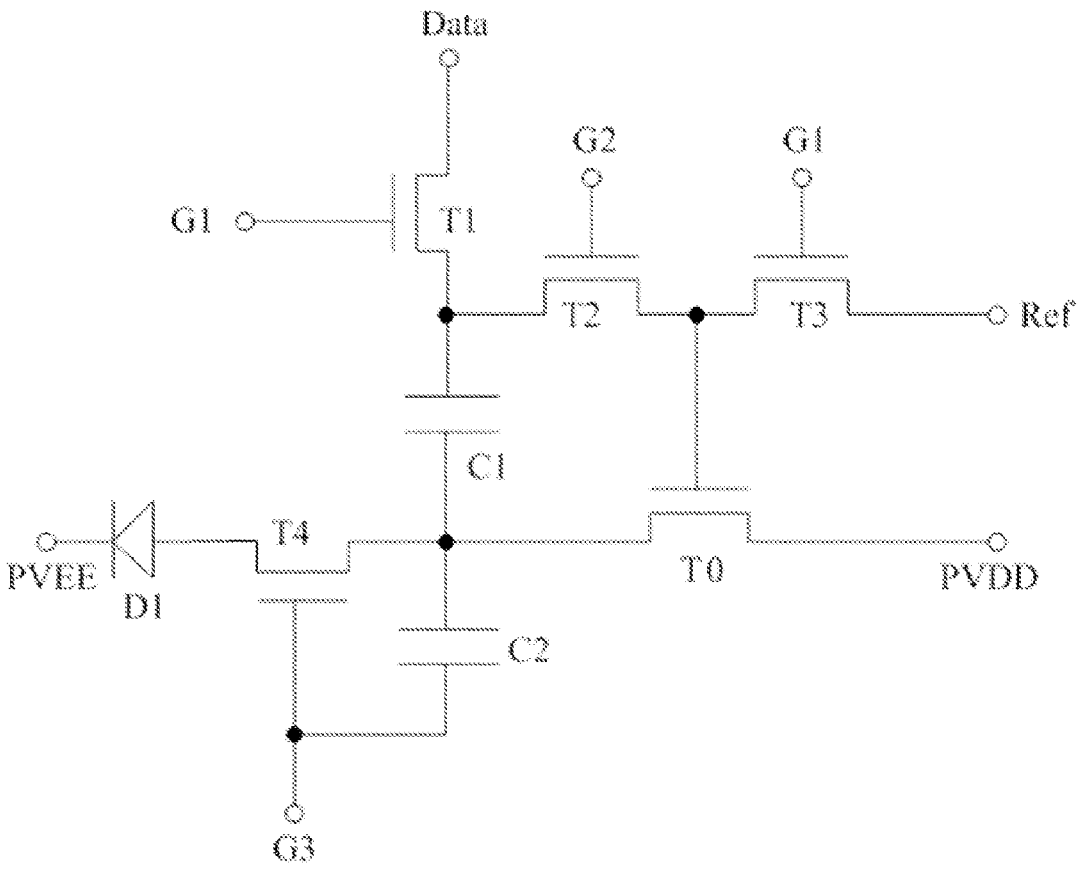
FIG. 2 is a schematic structural diagram of a pixel circuit according to an embodiment of the disclosure.

As shown in FIG. 2, a pixel circuit for driving a light emitting element D1 is provided according to an embodiment of the disclosure. The pixel circuit includes: a first capacitor C1, a second capacitor C2, a driving transistor T0, a first transistor T1, a second transistor T2, a third transistor T3 and a fourth transistor T4; where the first transistor T1 is controlled by a first driving signal G1 and is configured to transmit a data signal Date to a first electrode of the first capacitor C1;

the second transistor T2 is controlled by a second driving signal G2 and is configured to transmit the date signal Date to a gate of the driving transistor T0;

the third transistor T3 is controlled by the first driving signal G1 and is configured to transmit a reference signal Ref to the gate of the driving transistor T0;

the driving transistor T0 is configured to determine a magnitude of a driving current, where the driving current depends on a voltage difference between the gate and a source of the driving transistor T0;

the fourth transistor T4 is controlled by a third driving signal G3 and is configured to transmit the driving current from the driving transistor T0 to the light emitting element D1;

the first capacitor C1 is configured to store the data signal and stabilize the voltage difference between the gate and the source of the driving transistor T0; and the second capacitor C2 is configured to stabilize a source voltage of the driving transistor.

Specifically, a gate of the first transistor T1 is controlled by the first driving signal G1, a first electrode of the first transistor T1 is connected to a signal data end, a second electrode of the first transistor T1 is connected to a first electrode of the second transistor T2 and the first electrode of the first capacitor C1;

a gate of the second transistor T2 is controlled by the second driving signal G2, a second electrode of the second transistor T2 is connected to the gate of the driving transistor T0 and a second electrode of the third transistor T3;

a first electrode of the third transistor T3 is connected to a reference signal end Ref;

a drain of the driving transistor T0 is connected to a first power source PVDD end, a source of the driving transistor T0 is connected to a second electrode of the first capacitor C1, to a first electrode of the second capacitor C2, and to a first electrode of the fourth transistor T4;

a second electrode of the second capacitor C2 is connected to a gate of the fourth transistor T4 and a third driving signal G3 end;

a second electrode of the fourth transistor T4 is connected to the a first end of the light emitting element D1; and a second end of the light emitting element D1 is connected to a second power source PVEE.

Figure 3:
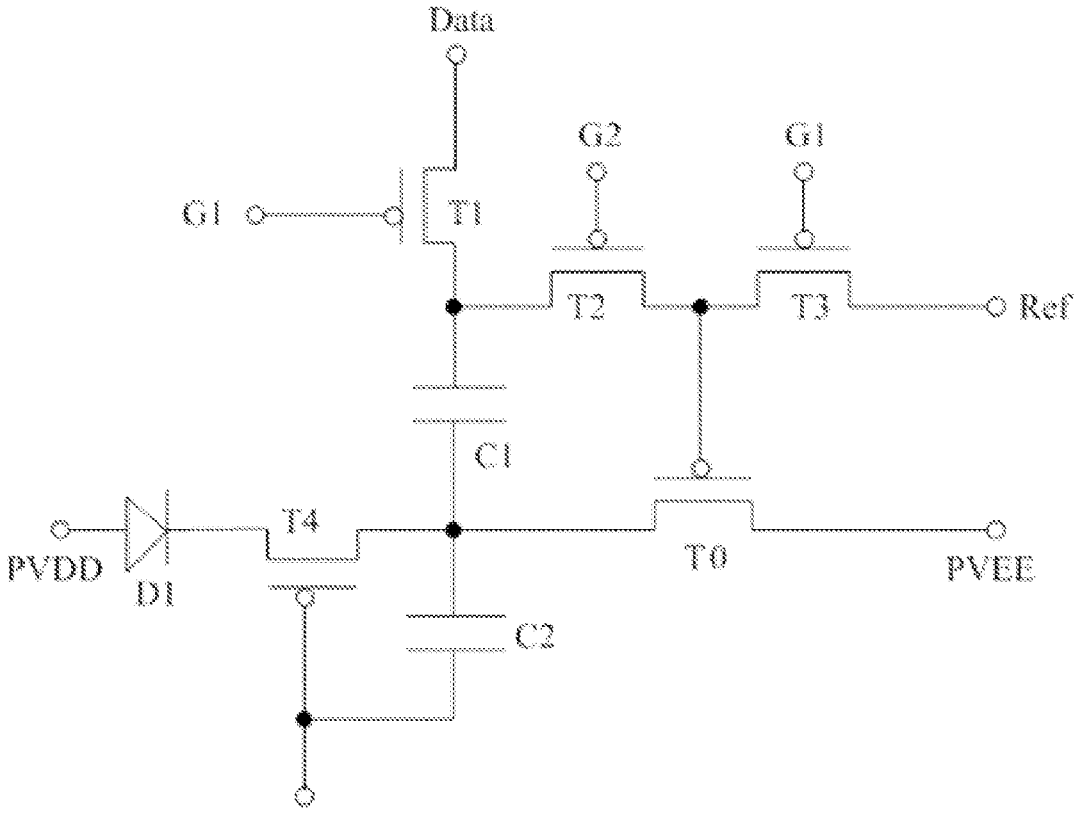
FIG. 3 is a schematic structural diagram of another pixel circuit according to another embodiment of the disclosure.

It can be seen that in this embodiment of the disclosure, the first transistor T1, the second transistor T2, the third transistor T3, the fourth transistor T4 and the driving transistor T0 are N-type transistors, and in this case, the first power source PVDD, to which the drain of the driving transistor T0 is connected, is at a high potential, the second end of the light emitting element D1 is a cathode, the second power source PVEE, to which the second end of the light emitting element D1 is connected, is at a low potential, a voltage of PVDD is higher than that of PVEE; of course, the first transistor T1, the second transistor T2, the third transistor T3, the fourth transistor T4 and the driving transistor T0 may alternatively be P-type transistors, as shown in FIG. 3, and in this case the first power source, to which the drain of the driving transistor T0 is connected, is a low-potential PVEE, the second end of the light emitting element D1 is an anode, the second power source, to which the second end of the light emitting element is connected, is a high-potential PVDD, and a voltage of PVDD is higher than that of PVEE.

Figure 4:
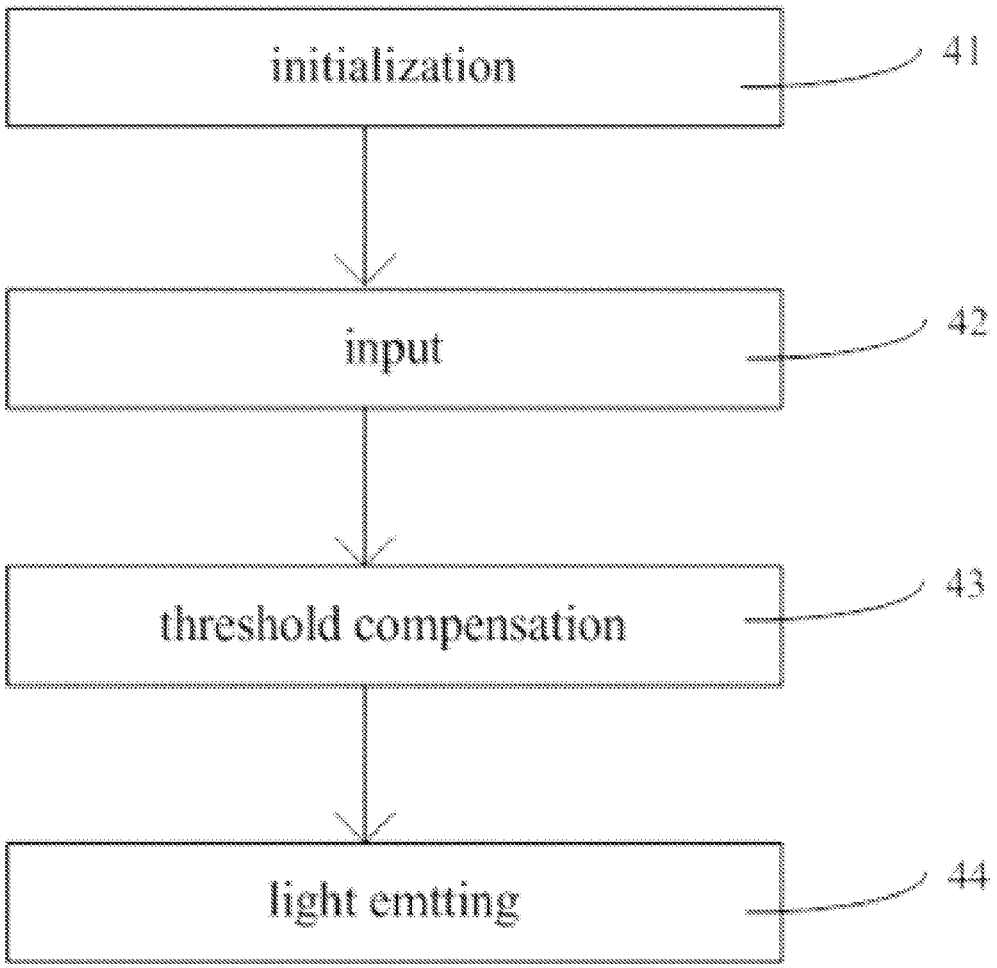
FIG. 4 is a flow chart of a method for compensating an OLED pixel driving circuit.
Figure 5:
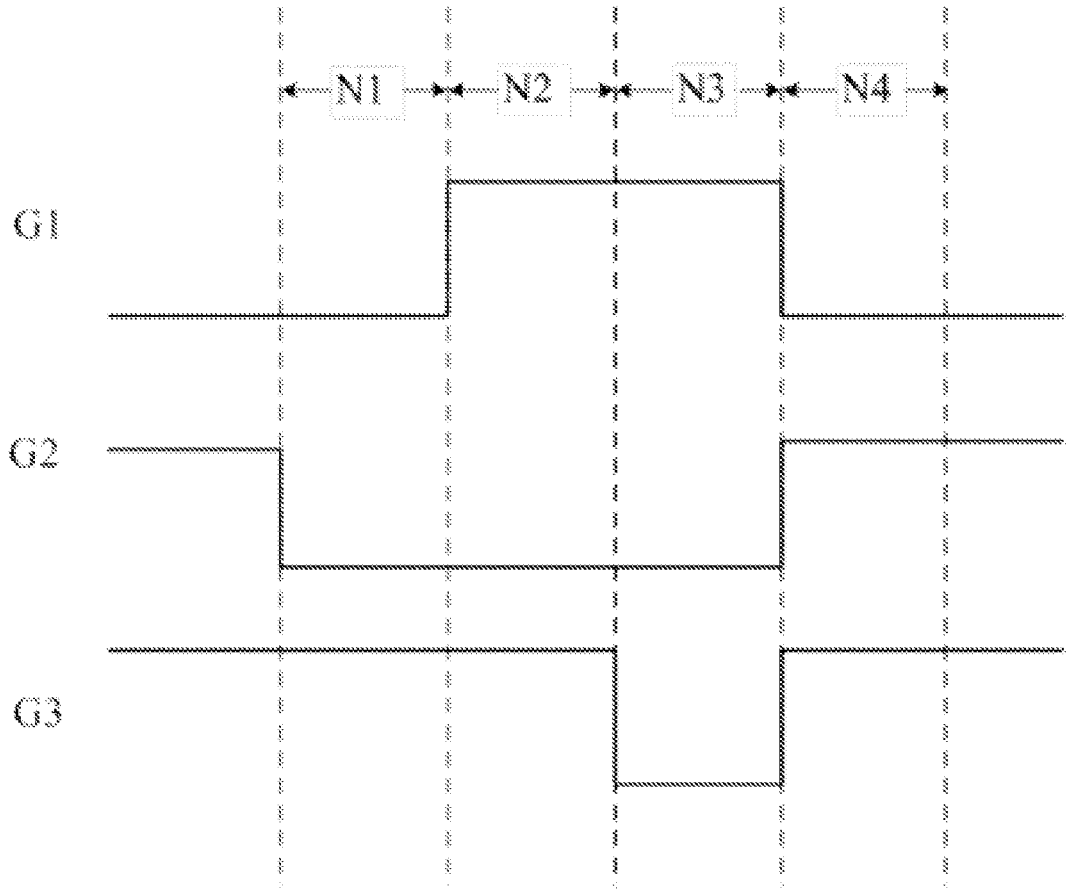
FIG. 5 is a schematic diagram of signals in an OLED pixel driving circuit.

As shown in FIG. 4, a time sequence of a method for compensating a driving circuit of a pixel circuit according to the embodiment of the disclosure may include four stages: an initialization stage 41, an input stage 42, a threshold compensation stage 43 and a light emitting stage 44. Specifically, FIG. 5 is a schematic diagram of signals in an OLED pixel driving circuit. In the following, description is made in conjunction with the driving signal and the pixel circuit in the FIG. 2.

As shown in FIG. 5, in the initialization stage N1, the first driving signal G1 is at low level, the second driving signal G2 is at low level, the third driving signal G3 is at high level; in the input stage N2, the first driving signal G1 is at high level, the second driving signal G2 is at low level, the third driving signal G3 is at high level; in the threshold compensation stage N3, the first driving signal G1 is at high level, the second driving signal G2 is at low level, the third driving signal G3 is at low level; in the light emitting stage N4, the first driving signal G1 is at low level, the second driving signal G2 and the third driving signal G3 are at high level.

Figure 6:
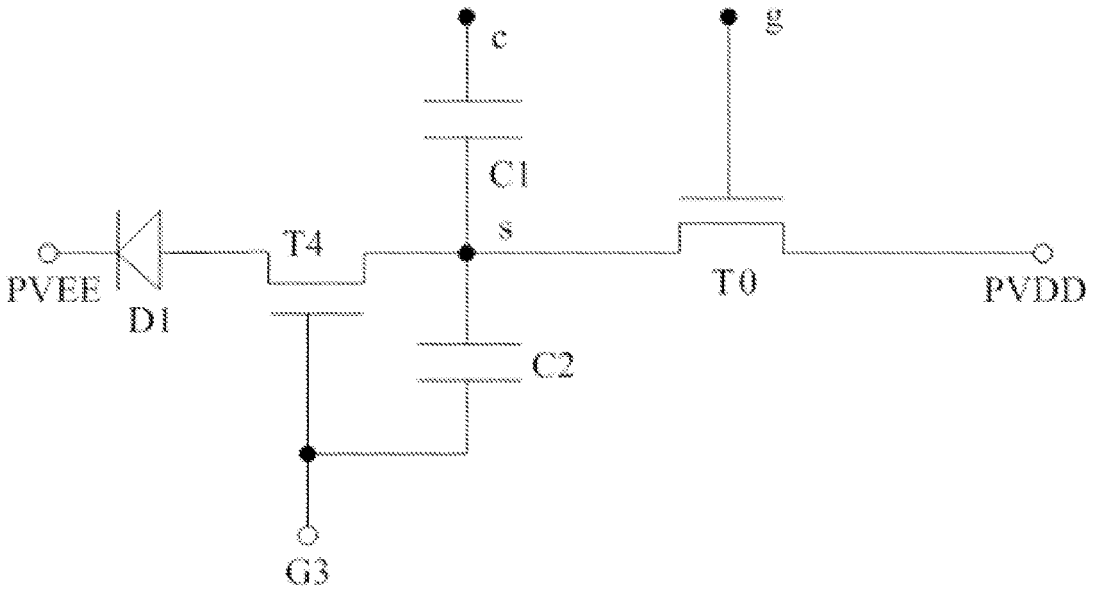
FIG. 6 is a schematic diagram of a pixel circuit in an initialization stage according to another embodiment of the disclosure.

Specifically, in the initialization stage, the second power source signal PVEE is transmitted to the source of the driving transistor T0 through the light emitting element D1 and the fourth transistor T4. Referring to FIG. 6, which shows the pixel circuit corresponding to the initialization stage N1, together with FIG. 5, it is may be known that, only the third driving signal G3 is at high level, the fourth transistor T4 is controlled to be switched on, the second power source signal PVEE is fed to node s through the light emitting element and the fourth transistor, so that Vs=PVEE+ΔV, where ΔV is voltage distributed over the light emitting element D1. Since the first transistor, the second transistor and the third transistor are switched off, node c and node g are floated, values of Vc and Vg are unknown, and it is unknown whether the driving transistor is on or off. Normally, a signal of a previous frame is kept at the node g, and the driving transistor is in on-status. It should be noted that although the light emitting element D1 may emit light in this stage, it is imperceptible to human eyes because the emission only lasts for a very short time.

Figure 7:
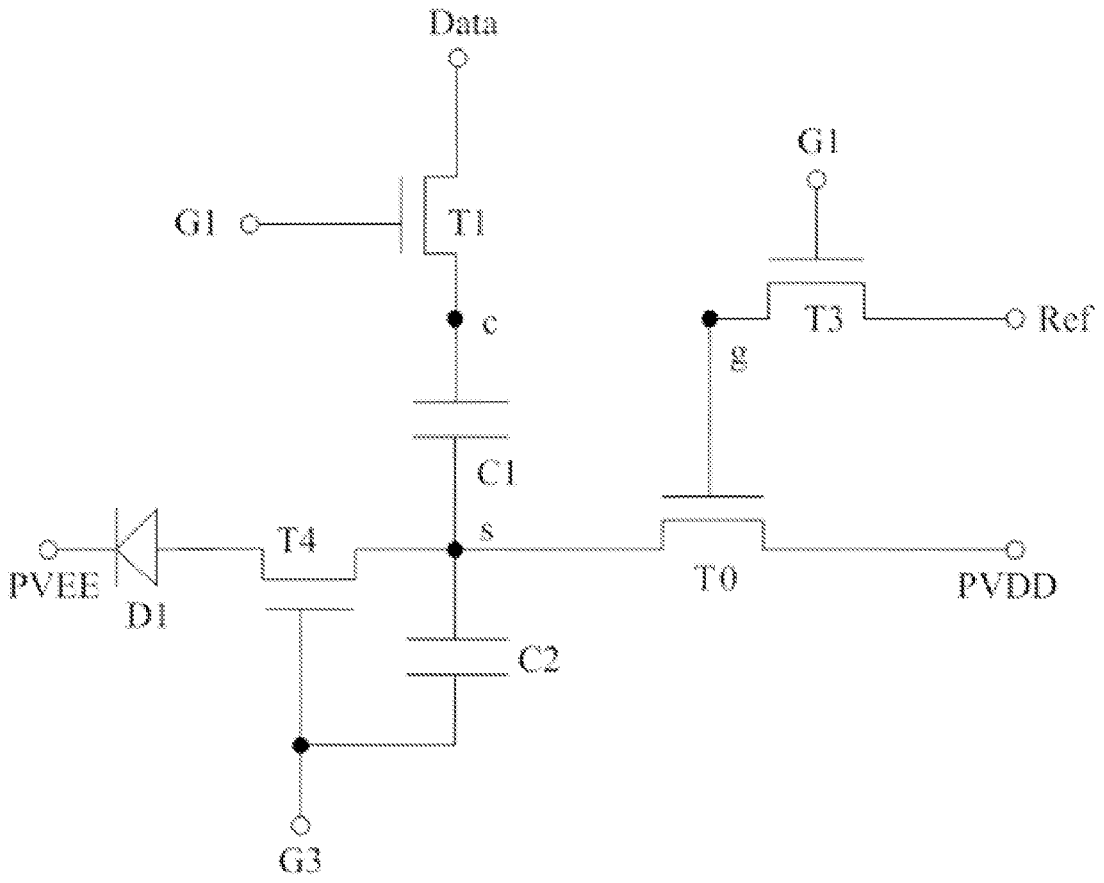
FIG. 7 is a schematic structural diagram of a pixel circuit in an input stage according to another embodiment of the disclosure.

In the input stage, the reference signal Ref is transmitted to the gate of the driving transistor T0 through the third transistor T3 to control the driving transistor T0 to be turned on; the data signal Date is transmitted to the first electrode of the first capacitor C1 through the first transistor T1. Referring to FIG. 7, which shows the pixel circuit corresponding to the input stage N2, together with FIG. 2, since the first driving signal G1 and the third driving signal G3 are at high level, the second driving signal G2 is at low level, the first transistor T1, the third transistor T3 and the fourth transistor T4 are controlled to be switched on, and the second transistor T2 is controlled to be switched off. Since the first transistor T1 is switched on, the data signal Data may be transmitted to the first electrode of the first capacitor C1 and node c at the first electrode for the second transistor, and is stored in the first capacitor C1, so that Vc=Vdata. Since the third transistor T3 is switched on, the reference signal Ref may be transmitted to node g at the gate of the driving transistor T0, so that Vg=Vref. Since the fourth transistor T4 is still on, Vs=PVEE+ΔV, where ΔV is voltage distributed over the light emitting element D1. In this case, Vgs=Vg−Vs=Vref−(PVEE+ΔV). To turn the driving transistor on, it is needed that Vgs>Vth, where Vth is the threshold voltage of the driving transistor T0, therefore it is needed that the reference signal Vref>PVEE+ΔV+Vth. It is should be noted that by virtue of the second capacitor C2 having the first electrode connected to the source of the driving electrode T0, the source voltage may be stabilized. It should be noted that although the light emitting element D1 may emit light in this stage, it is imperceptible to human eyes because the emission only lasts for a very short time.

Figure 8:
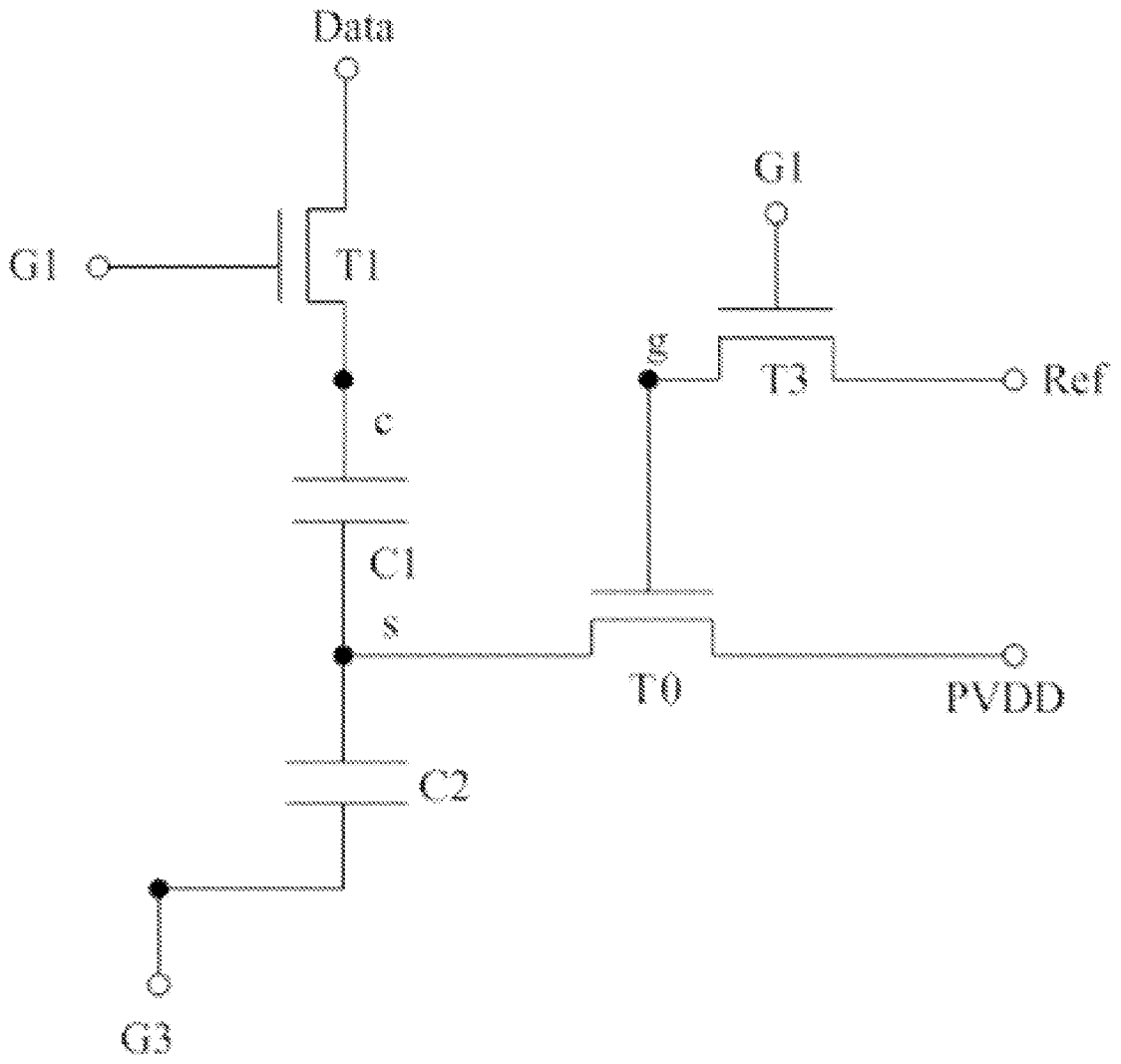
FIG. 8 is a schematic structural diagram of a pixel circuit in a threshold compensation stage according to another embodiment of the disclosure.
Figure 10:
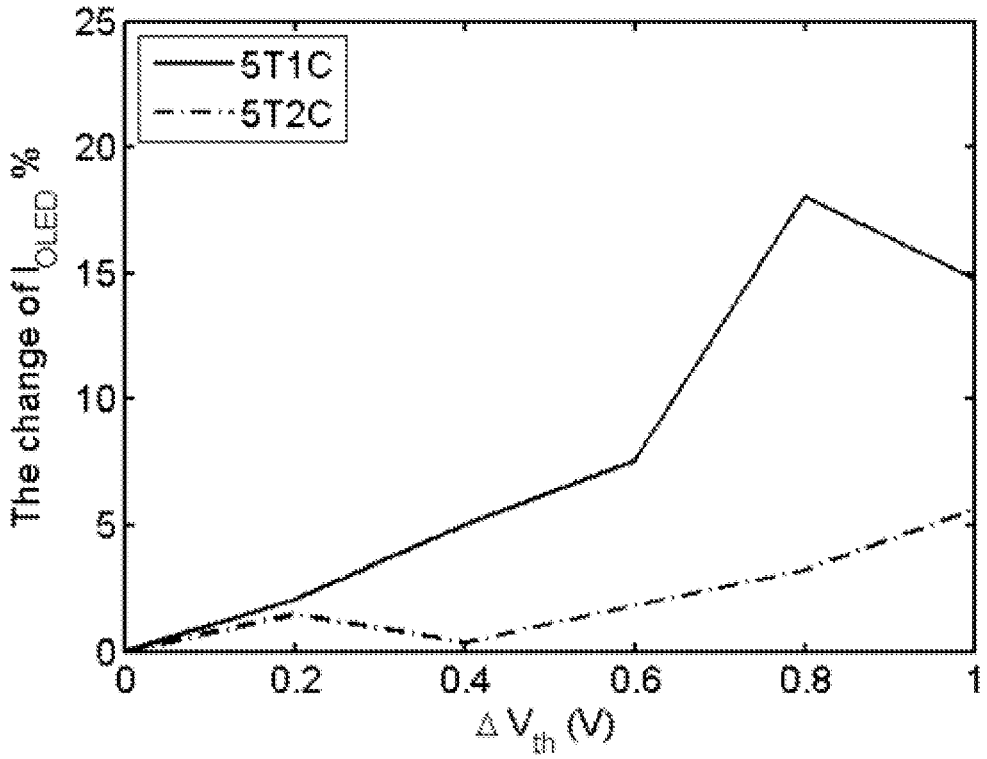
FIG. 10 is a comparison chart showing an effect of the compensation made for a pixel circuit structure according to another embodiment of the disclosure.

In the threshold compensation stage, in a case that the voltage difference between the gate and the source of the driving transistor T0 equals to the threshold voltage of the driving transistor T0, the driving transistor T0 is turned off. Referring to FIG. 8, which shows the pixel circuit corresponding to the threshold compensation stage N3, together with FIG. 2, since the first driving signal G1 is at high level, the second driving signal G2 and the third driving signal G3 are at low level, the first transistor T1 and the third transistor T3 are controlled to be switched on, and the second transistor and the fourth transistor are controlled to be switched off. Since the first transistor T1 is switched on, Vc=Vdata; since the third transistor T3 is switched on, the reference signal Ref may be transmitted to node g at the driving transistor T0 through the third transistor T3 so that Vg=Vref. Since the fourth transistor is switched off, a potential of the node s is not constant, a current passing through the driving transistor T0 gradually reduces, and the driving transistor T0 gradually changes from turned-on state to off state, and is turned off when the potential of the node s changes into Vref−Vth, where Vth is the threshold voltage of the driving transistor T0. At this time, the voltage difference Vgs between the source voltage and the gate voltage of the driving transistor T0 equals to Vth, the threshold voltage is saved at the node s, and the compensation is implemented. In the process, in one aspect, the first capacitor C1 has a function of storing the signal Data and keeping the voltage difference between the gate and source of the driving transistor T0; since the second capacitor C2 is not electrically connected to the data signal Data and the driving transistor T0 is in on state, the second capacitor C2 is not coupled with the first capacitor C1, and the second capacitor C2 may neither affect the storage of the signal Data by the first capacitor C1 nor affect a process for compensating the circuit. In another aspect, the second capacitor C2 may stabilize the source voltage of the driving transistor T0, and the stabilization of the source voltage of the driving transistor T0 is helpful for compensating the threshold of the driving transistor. This may be verified through simulated data. In FIG. 10, a comparison chart of simulated compensation effects for the pixel circuit having the second capacitor C2 (the circuit includes the first transistor, the second transistor, the third transistor, the fourth transistor, the driving transistor, the first capacitor and the second capacitor and forms 5T2C) and the pixel circuit not having the second capacitor C2 (the circuit includes the first transistor, the second transistor, the third transistor, the fourth transistor, the driving transistor, and the first capacitor and forms 5T1C) is shown. It should be noted that according to the embodiment of the disclosure, although in the light emitting stage the operating current IOLED of the light emitting element D1 is independent from the threshold voltage and theoretically a drift of the threshold voltage may not affect the operating current IOLED of the light emitting element D1, the operating current IOLED of the light emitting element D1 may still be affected by the drift of the threshold voltage in practical circuit operation, and the process for compensating the threshold according to the embodiment of the disclosure may greatly reduce affection exerted by the drift of the threshold voltage on the operating current IOLED of the light emitting element D1. Still referring to FIG. 10, the abscissa represents a drift ΔVth of the threshold of the driving transistor T0, and the ordinate represents the change percentage of the operating current IOLED with respect to the drift ΔVth of the threshold of the driving transistor T0, where the operating current IOLED is configured for driving the light emitting element D1 to emit light. It is may be apparently seen that the maximum change percentage of the operating current IOLED for the 5T2C pixel circuit is 6%, the maximum change percentage of the operating current IOLED for the 5T1C pixel circuit is up to 18%; and in a case that the drift ΔVth of the threshold ranges from 0.2V-0.4V, the change percentage of the operating current IOLED for the pixel circuit 5T2C appears a downward trend, which means that stabilizing the source potential of the driving transistor T0 through the second capacitor C2 is beneficial for compensating the threshold of the driving transistor T0.

Figure 9:
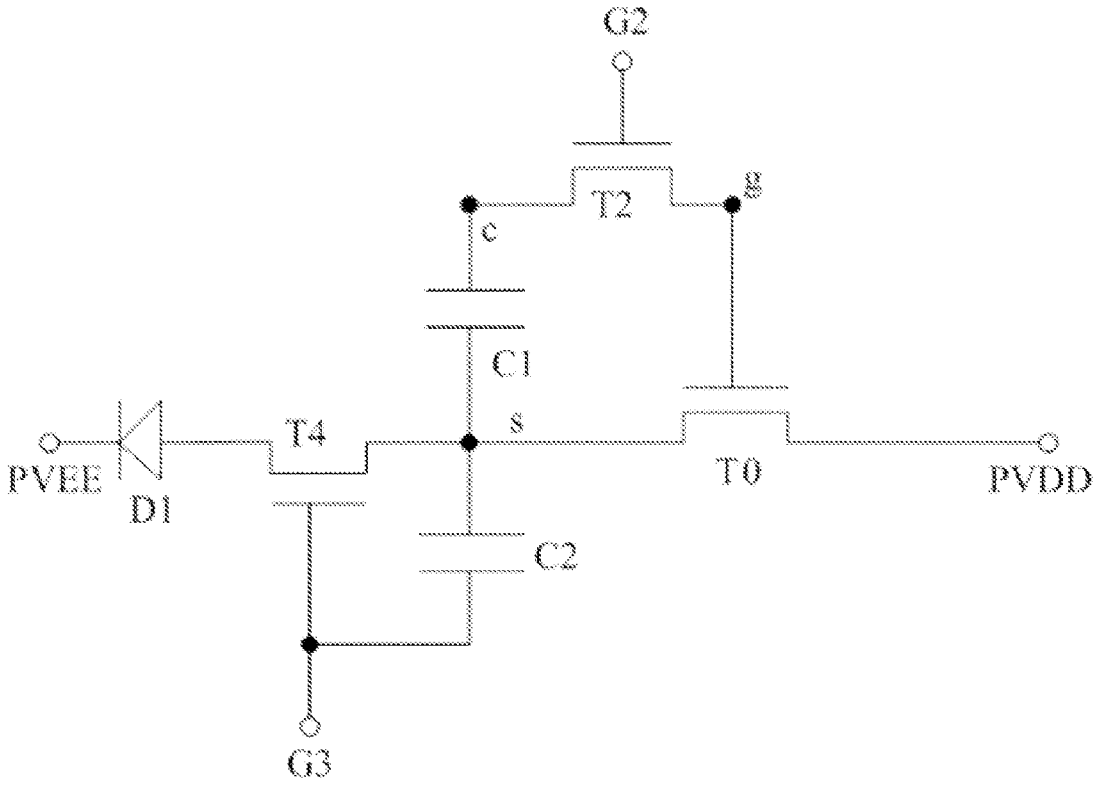
FIG. 9 is a schematic structural diagram of a pixel circuit in a light emitting stage according to another embodiment of the disclosure.

In the light emitting stage, the driving current $I_{OLED}$ depends on the voltage difference between the gate and the source of the driving transistor T0, the driving current $I_{OLED}$ is transmitted to the light emitting element D1 by the fourth transistor T4; in response to the driving current IOLED, the light emitting element D1 emits light to implement display. Referring to FIG. 9, which shows the pixel circuit corresponding to the light emitting stage N4, in conjunction with FIG. 5, since the first driving signal G1 is at low level, the second driving signal G2 and the third driving signal G3 are at high level, the second transistor T2 and the fourth transistor T4 are controlled to be switched on, and the first transistor and the third transistor are controlled to be switched off, so that the signal Data stored in the first capacitor C1 is transmitted to the node g at the gate of the driving transistor T0 through the second transistor T2, therefore Vg=Vc=Vdata; given Vs=Vref−Vth in the threshold compensation stage, it may be derived that Vgs=Vdata−Vref+Vth; the first capacitor C1 may have a function of stabilizing the voltage difference between the gate and the source of the driving transistor T0; since the driving transistor T0 operates in a saturation state, it may be known according to the current characteristics in the saturation state, the operating current $I_{OLED}$ which passes through the driving transistor T0 and is configured to drive the light emitting element D1 to emit light satisfies a formula: $I_{OLED}=K(Vgs-Vth)^2=K[(Vdata-Vref+Vth)-Vth]^2=K(Vdata-Vref)^2$, where the k is a structure parameter having a relatively stable value in a same structure and therefore to be considered as a constant. It may be seen that the operating current IOLED of the light emitting element D1 is no longer affected by the threshold voltage $V_{th}$ of the driving transistor T0 and is only relevant to the signal voltage Vdata input from the data signal end and the voltage Vref at the reference signal end, thereby completely solving a problem that an operating current $I_{OLED}$ of a light emitting element D1 is affected by a drift of the threshold voltage $V_{th}$ of the driving transistor caused by manufacture process and longtime operation, so as to ensure that the light emitting element D1 may function normally. It is should be noted that, at the moment that the third driving signal G3 drops from the high level to the low level, a transition occurs at the second electrode of the second capacitor C2 and in turn an instantaneous pull occurs at the first electrode of the second capacitors C2, which may lower the source potential of the driving transistor T0, so that the circuit may work at a lower Vref, a demand for an external signal such as an output signal of a driving IC or a driving flexible circuit board may be lowered, a demand for the driving IC or the driving flexible circuit board is reduced, power consumption is reduced and the cost is decreased.

It should be noted that there is generally an adjusting stage (not shown) between the threshold compensation stage N3 and the light emitting stage N4. It may be known from FIG. 5 that at the end of the threshold compensation stage N3, the first driving signal G1 is at high level, the second driving signal G2 and the third driving signal G3 are at low level, while in the following light emitting stage N4, the first driving signal G1 needs to change from high level to low level, the second driving signal G2 and the third driving signal G3 need to change from low level to high level. In practice, normally the first driving signal G1 is changed from high level to low level first, then an experiment is needed for determining the order regarding whether to first adjust the second driving signal G2 to the high level or to first adjust the third driving signal G3 to the high level first or to adjust the second driving signal G2 and the third driving signal G3 to the high level at the same time, therefore the adjusting stage and change of driving signals in the stage are not shown in the schematic diagram (FIG. 5) showing signals of the OLED pixel driving circuit according to the embodiment of the disclosure.

A pixel circuit is further provided according to an embodiment of the disclosure. As shown in FIG. 2, the pixel circuit for driving a light emitting element D1 includes: a first capacitor C1, a second capacitor C2, a driving transistor T0, a first transistor T1, a second transistor T2, a third transistor T3 and a fourth transistor T4;

a gate of the first transistor T1 is connected to a first driving signal end G1, a first electrode of the first transistor T1 is connected to a data signal end Data, a second electrode of the first transistor T1 is connected to a first electrode of the second transistor T2 and a first electrode of the first capacitor C1;

a gate of the second transistor T2 is connected to a second driving signal end G2, a second electrode of the second transistor T2 is connected to a gate of the driving transistor T0 and a second electrode of the third transistor T3;

a gate of the third transistor T3 is connected to the first driving signal end G1, a first electrode of the third transistor T3 is connected to a reference signal end Ref;

a drain of the driving transistor T0 is connected to a first power source PVDD, a source of the driving transistor T0 is connected to a second electrode of the first capacitor C1, a first electrode of the second capacitor C2, and a first electrode of the fourth transistor T4;

a second electrode of the second capacitor C2 is connected to a gate of the fourth transistor T4 and a third driving signal end G3;

the gate of the fourth transistor T4 is connected to the third driving signal end G3 and the first electrode of the second capacitor C2, and a second electrode of the fourth transistor T4 is connected to a first end of the light emitting element D1;

a second end of the light emitting element D1 is connected to a second power source PVEE.

It can be seen that, in the embodiment of the disclosure, since the driving transistor T0, the first transistor T1, the second transistor T2, the third transistor T3 and the fourth transistor T4 are all N-type transistors, the first power source PVDD connected to the drain of the driving transistor T0 is at a high potential, a second end of the light emitting element D1 is a cathode, the second power source PVEE connected to the second end of the light emitting element D1 is at a low potential, a voltage of the PVDD is higher than that of the PVEE.

In another embodiment, the driving transistor T0, the first transistor T1, the second transistor T2, the third transistor T3 and the fourth transistor T4 are all p-type transistors. As shown in FIG. 3, the pixel circuit for driving the light emitting element D1 includes: a first capacitor C1, a second capacitor C2, the driving transistor T0, the first transistor T1, the second transistor T2, the third transistor T3 and the fourth transistor T4;

a gate of the first transistor T1 is connected to a first driving signal end G1, a first electrode of the first transistor T1 is connected to a data signal end Data, a second electrode of the first transistor T1 is connected to a first electrode of the second transistor T2 and a first electrode of the first capacitor C1;

a gate of the second transistor T2 is connected to a second driving signal end G2, and a second electrode of the second transistor T2 is connected to a gate of the driving transistor T0 and a second electrode of the third transistor T3;

a gate of the third transistor T3 is connected to the first driving signal end G1, and a first electrode of the third transistor T3 is connected to a reference signal end Ref;

a drain of the driving transistor T0 is connected to a first power source PVEE, a source of the driving transistor T0 is connected to a second electrode of the first capacitor C1, a first electrode of the second capacitor C2 and a first electrode of the fourth transistor T4;

a second electrode of the second capacitor C2 is connected to a gate of the fourth transistor T4 and a third driving signal end G3;

a gate of the fourth transistor T4 is connected to the third driving signal end G3 and the first electrode of the second capacitor C2, a second electrode of the fourth transistor T4 is connected to a first end of the light emitting element D1; and a second end of the light emitting element D1 is connected to a second power source PVDD.

It can be seen that, according to the embodiment of the disclosure, since the driving transistor T0, the first transistor T1, the second transistor T2, the third transistor T3 and the fourth transistor T4 are all P-type transistors, the first power source PVEE connected to the drain of the driving transistor T0 is at the low potential, a second end of the light emitting element D1 is a cathode, the second power source PVDD connected to the second end of the light emitting element D1 is at the high potential, a voltage of the PVDD is higher than that of the PVEE. Of course, signals (not shown) of driving circuit corresponding to the pixel circuit should be accordingly adjusted based on the driving signals (FIG. 5) of the pixel circuit including all N-type transistors such that for the first driving signal, the second driving signal and the third driving signal, high potential changes to the low potential and the low potential changes to the high potential. The operating principle of the pixel circuit is the same as that of the pixel circuit of which the driving transistor, the first transistor, the second transistor, the third transistor and the fourth transistor are all N-type transistors, and description thereof is omitted. Since all transistors are P-type transistors, comparing to the case that all transistors are of N-type, manufacture process is relatively simple, procedure may be simplified and cost may be reduced. Of course, it is possible that some of the transistors are N-type transistors and some are P-type transistors, and the driving signals need to be adjusted accordingly; but the principle is basically the same as that of the pixel circuit of which the driving transistor, the first transistor, the second transistor, the third transistor and the fourth transistor are all N-type transistors or all P-type transistors; the implementation process is relatively complicated and description thereof is omitted.

It should be noted that, persons skilled in the art should understand that under a certain circumstance, a source and a drain may be exchanged with each other, and in the above embodiments the source and the drain may be exchanged with each other under a certain circumstance. In addition, the connections described according to the embodiments of the disclosure include electrical connections and physical connections.

Figure 11:
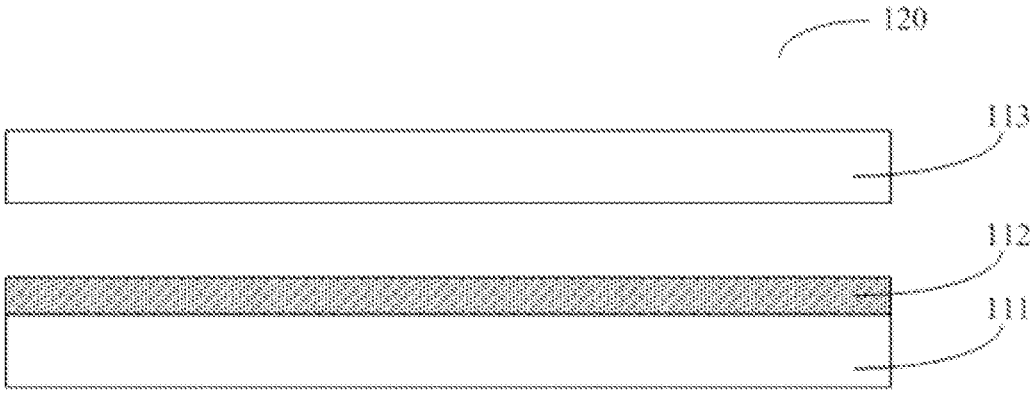
FIG. 11 is a schematic structural diagram of an organic electroluminescent display panel.

Based on a same inventive conception, an organic electroluminescent display panel is further provided according to an embodiment of the disclosure. The organic electroluminescent display panel includes a plurality of pixel circuits according any one of the above embodiments of the disclosure. As shown in FIG. 11, the organic electroluminescent display panel 120 includes a first substrate 111 and a second substrate 113 which are disposed to be opposite to each other; a pixel circuit layer 112 is disposed on an inner surface of the first substrate; and the pixel circuit layer 112 includes any one of the pixel circuits provided according to the embodiments of the disclosure. Normally, the first substrate 111 and the second substrate 113 further include light emitting material (not shown). Since the organic electroluminescent display panel resolves the problem in a principle similar to that of the pixel circuit, for the implementation of the organic electroluminescent display panel one may refer to the implementation of the pixel circuit, and detailed description is omitted herein.

Preferably, to optimize circuit structure, in the organic electroluminescent display panel provided according to the embodiment of the disclosure, the first driving signal end, the second driving signal end and the third driving signal end of each pixel circuit may be all electrically connected to a scanning signal generator for the row where the pixel circuit resides. The scanning signal generator may either be disposed in a driving IC, or be disposed on the organic electroluminescent display panel. Generally, the scanning signal generator may be electrically connected to an external signal; the reference signal, the high potential power source PVDD and the low potential power source PVEED may be directly and electrically connected to the external signal; and the external signal may be an output signal of a component such as the driving IC or the driving flexible circuit board.

Figure 12:
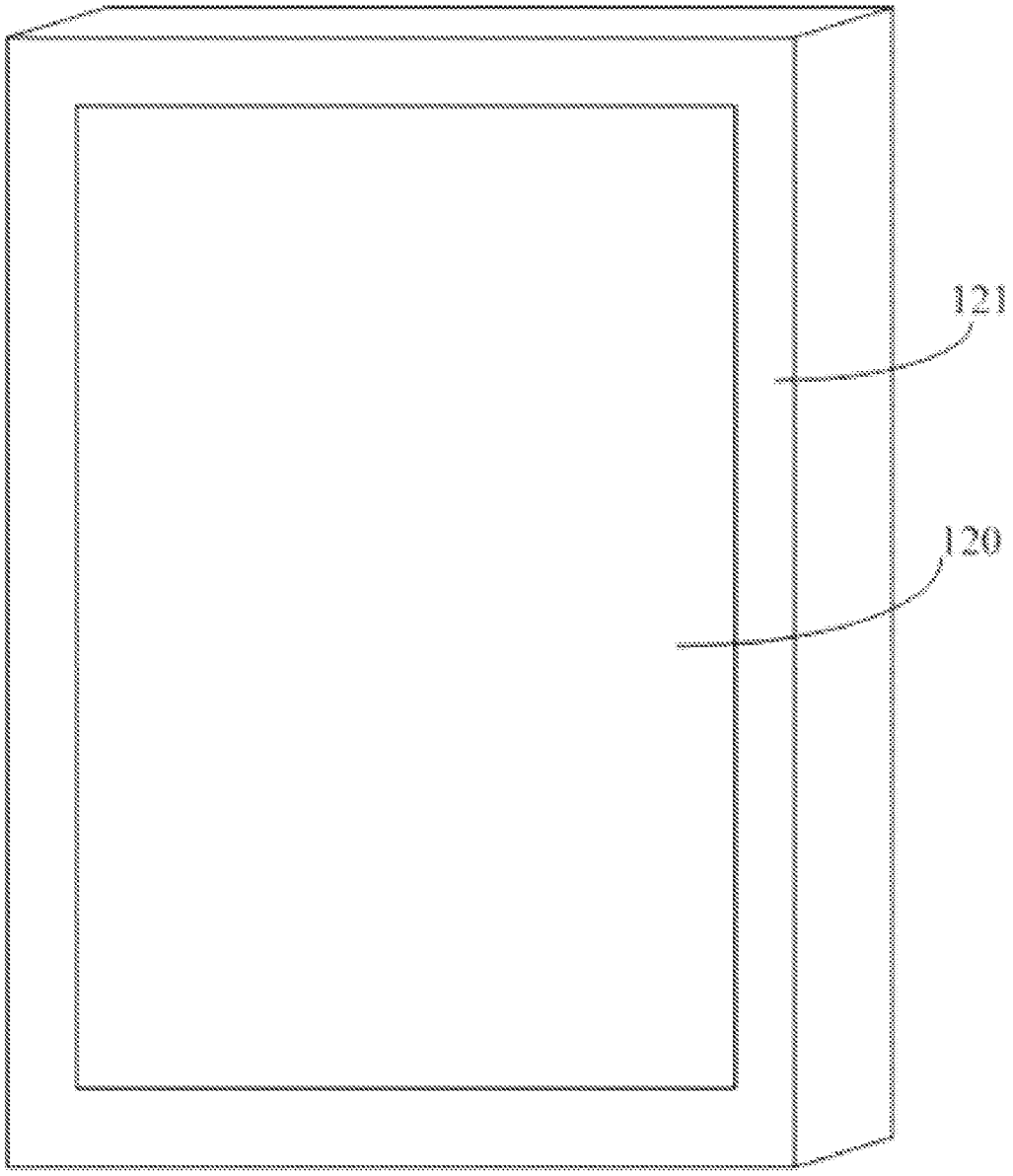
FIG. 12 is a schematic structural diagram of a display device.

Based on a same inventive concept, a display device is further provided according to the embodiment of the disclosure. The display device includes the foregoing organic electroluminescent display panel provided according to the above embodiment of the disclosure. As shown in FIG. 12, the display device includes a casing 121 and the organic electroluminescent display panel 120. The display device may be a displayer, a mobile phone, a TV, a laptop, a tablet computer or a one-in-all device. It is should be understood by persons skilled in the art that the display device includes other indispensable components, these components are not described here and should not limit the disclosure.

In the pixel circuit, the organic electroluminescent display panel and the display device provided according to the embodiments of the disclosure, due to a stabilizing effect of a second capacitor, a source potential of a driving transistor is stabilized and then a compensation process is stabilized, so that the circuit may work at a lower reference potential, a demand for an external control signal, which may be an output signal of a driving IC or a driving flexible circuit board, is lowered, thereby lowering a demand for the driving IC or the driving flexible circuit board, saving power consumption and reducing cost; a drift of a threshold voltage for the driving transistor may be compensated in a threshold compensation stage, hence, in a light emitting stage, an operating current which may enable the light emitting element to emit light is only relevant to a voltage of a data signal input from a data signal end and a voltage at a reference signal end, and is independent from the threshold voltage of the driving transistor, avoiding affection of the threshold voltage on the light emitting element, so as to stabilize the operating current for driving the light emitting element to emit light, and improve stability of the pixel circuit and uniformity in brightness of images in a display area of the organic electroluminescent display panel and the display device.

Apparently, some modifications and variants may be made by those skilled in the art within the scope and spirit of the disclosure. Hence, the disclosure intends to cover any of the modifications and variants within the scope defined by the claims of the disclosure and equivalents thereof.

What is claimed is:

1. A pixel circuit for driving a light emitting element, wherein the pixel circuit comprises:

a first capacitor;

a second capacitor;

a driving transistor, wherein the driving transistor is configured generate a driving current, wherein the magnitude of the driving current depends on a voltage difference between the gate and a source of the driving transistor;

a first transistor, wherein the first transistor is controlled by a first driving signal and is configured to transmit a data signal to a first electrode of the first capacitor;

a second transistor, wherein the second transistor is controlled by a second driving signal and is configured to transmit the data signal to a gate of the driving transistor;

a third transistor, wherein the third transistor is controlled by the first driving signal and is configured to transmit a reference signal to the gate of the driving transistor; and a fourth transistor, wherein the fourth transistor is controlled by a third driving signal and is configured to transmit the driving current from the driving transistor to the light emitting element, wherein:

the first capacitor is configured to store the data signal and to stabilize the voltage difference between the gate and the source of the driving transistor, and the second capacitor is configured to stabilize a source voltage of the driving transistor.

2. The pixel circuit according to claim 1, wherein:

a first electrode of the first transistor is connected to a data signal, a second electrode of the first transistor is connected to a first electrode of the second transistor and to the first electrode of the first capacitor;

a second electrode of the second transistor is connected to the gate of the driving transistor and to a second electrode of the third transistor;

a first electrode of the third transistor is connected to a reference signal;

a drain of the driving transistor is connected to a first power source, the source of the driving transistor is connected to a second electrode of the first capacitor, to the first electrode of the second capacitor, and to a first electrode of the fourth transistor;

a second electrode of the second capacitor is connected to a gate of the fourth transistor and to a third driving signal;

a second electrode of the fourth transistor is connected to a first electrode of the light emitting element; and a second electrode of the light emitting element is connected to a second power source.

3. A pixel circuit for driving a light emitting element, the pixel circuit comprising: a first capacitor; a second capacitor; a driving transistor; a first transistor, wherein a gate of the first transistor is directly connected to a first driving signal, a first electrode of the first transistor is directly connected to a data signal, a second electrode of the first transistor is directly connected to a first electrode of the second transistor and to a first electrode of the first capacitor; a second transistor; a third transistor; and a fourth transistor, wherein the gate of the fourth transistor is directly connected to the third driving signal and the second electrode of the second capacitor, and a second electrode of the fourth transistor is directly connected to a first electrode of the light emitting element; wherein: a gate of the third transistor is directly connected to the first driving signal, a first electrode of the third transistor is directly connected to a reference signal; a drain of the driving transistor is directly connected to a first power source, a source of the driving transistor is directly connected to a second electrode of the first capacitor, to a first electrode of the second capacitor, and to a first electrode of the fourth transistor; a second electrode of the second capacitor is directly connected to a gate of the fourth transistor and to a third driving signal; and second electrode of the light emitting element is directly connected to a second power source.

4. The pixel circuit according to claim 3, wherein:

each of the first transistor, the second transistor, the third transistor, the fourth transistor and the driving transistor is an N-type transistor; or each of the first transistor, the second transistor, the third transistor, the fourth transistor and the driving transistor is a P-type transistor.

5. The pixel circuit according to claim 4, wherein a time sequence for driving the pixel circuit comprises an initialization stage, an input stage, a threshold compensation stage, and a light emitting stage.

6. The pixel circuit according to claim 5, wherein during the initialization stage, a signal of the second power source is transmitted to the source of the driving transistor through the light emitting element and the fourth transistor.

7. The pixel circuit according to claim 5, wherein during the input stage:

the reference signal is transmitted to the gate of the driving transistor through the third transistor to turn on the driving transistor; and the data signal is transmitted to the first electrode of the first capacitor through the first transistor.

8. The pixel circuit according to claim 5, wherein during the threshold compensation stage:

the driving transistor is turned off.

9. The pixel circuit according to claim 5, wherein during the light emitting stage:

a driving current depends on a voltage difference between the gate and the source of the driving transistor, the driving current is transmitted to the light emitting element through the fourth transistor, and in response to the driving current, the light emitting element emits light.

10. An organic electroluminescent display panel comprising a plurality of pixel circuits, wherein each pixel circuit comprises;

a first capacitor;

a second capacitor;

a driving transistor, wherein the driving transistor is configured to generate a driving current, wherein the magnitude of the driving current depends on a voltage difference between the gate and a source of the driving transistor;

a first transistor, wherein the first transistor is controlled by a first driving signal and is configured to transmit a data signal to a first electrode of the first capacitor;

a second transistor, wherein the second transistor is controlled by a second driving signal and is configured to transmit the data signal to a gate of the driving transistor;

a third transistor, wherein the third transistor is controlled by the first driving signal and is configured to transmit a reference signal to the gate of the driving transistor; and a fourth transistor, wherein the fourth transistor is controlled by a third driving signal and is configured to transmit the driving current from the driving transistor to the light emitting element, wherein:

the first capacitor is configured to store the data signal and to stabilize the voltage difference between the gate and the source of the driving transistor, and the second capacitor is configured to stabilize a source voltage of the driving transistor.

11. The organic electroluminescent display panel according to claim 10, wherein:

a first electrode of the first transistor is connected to a data signal, a second electrode of the first transistor is connected to a first electrode of the second transistor and to the first electrode of the first capacitor;

a second electrode of the second transistor is connected to the gate of the driving transistor and to a second electrode of the third transistor;

a first electrode of the third transistor is connected to a reference signal;

a drain of the driving transistor is connected to a first power source, the source of the driving transistor is connected to a second electrode of the first capacitor, to the first electrode of the second capacitor, and to a first electrode of the fourth transistor;

a second electrode of the second capacitor is connected to a gate of the fourth transistor and to a third driving signal;

a second electrode of the fourth transistor is connected to a first electrode of the light emitting element; and a second electrode of the light emitting element is connected to a second power source.

12. A display device comprising an organic electroluminescent display panel, the organic electroluminescent display panel comprising a plurality of pixel circuits, wherein each pixel circuit comprises: a first capacitor; a second capacitor; a driving transistor; a first transistor; a second transistor; a third transistor; and a fourth transistor, wherein: a gate of the first transistor is directly connected to a first driving signal, a first electrode of the first transistor is directly connected to a data signal, a second electrode of the first transistor is directly connected to a first electrode of the second transistor and to a first electrode of the first capacitor; a gate of the second transistor is directly connected to a second driving signal, a second electrode of the second transistor is directly connected to a gate of the driving transistor and to a second electrode of the third transistor; a gate of the third transistor is directly connected to the first driving signal, a first electrode of the third transistor is directly connected to a reference signal; a drain of the driving transistor is directly connected to a first power source, a source of the driving transistor is directly connected to a second electrode of the first capacitor, to a first electrode of the second capacitor, and to a first electrode of the fourth transistor; a second electrode of the second capacitor is directly connected to a gate of the fourth transistor and to a third driving signal; the gate of the fourth transistor is directly connected to the third driving signal and to the second electrode of the second capacitor, and a second electrode of the fourth transistor is directly connected to a first electrode of the light emitting element; and a second electrode of the light emitting element is directly connected to a second power source.

13. The display device according to claim 12, wherein:

each of the first transistor, the second transistor, the third transistor, the fourth transistor and the driving transistor is an N-type transistor; or each of the first transistor, the second transistor, the third transistor, the fourth transistor and the driving transistor is a P-type transistor.

14. The display device according to claim 13, wherein a time sequence for driving the pixel circuit comprises an initialization stage, an input stage, a threshold compensation stage and a light emitting stage.

15. The display device according to claim 14, wherein during the initialization stage, a signal of the second power source is transmitted to the source of the driving transistor through the light emitting element and the fourth transistor.

16. The display device according to claim 14, wherein during the input stage:

the reference signal is transmitted to the gate of the driving transistor through the third transistor to turn on the driving transistor; and the data signal is transmitted to the first electrode of the first capacitor through the first transistor.

17. The display device according to claim 14, wherein during the threshold compensation stage, the driving transistor is turned off.

18. The display device according to claim 14, wherein during the light emitting stage:

a driving current depends on a voltage difference between the gate and the source of the driving transistor;

the driving current is transmitted to the light emitting element through the fourth transistor; and in response to the driving current, the light emitting element emits light.

* * * * *